US009776059B1

(12) United States Patent
Buday

(10) Patent No.: US 9,776,059 B1
(45) Date of Patent: Oct. 3, 2017

(54) BALANCED GOLF CLUB HEAD

(71) Applicant: John J. Buday, Barnegat, NJ (US)

(72) Inventor: John J. Buday, Barnegat, NJ (US)

( * ) Notice: Subject to any disclaimer, the term of this patent is extended or adjusted under 35 U.S.C. 154(b) by 0 days.

(21) Appl. No.: 15/427,503

(22) Filed: Feb. 8, 2017

(51) Int. Cl.
*A63B 53/04* (2015.01)
*A63B 53/00* (2015.01)
*A63B 53/02* (2015.01)

(52) U.S. Cl.
CPC ..... *A63B 53/0466* (2013.01); *A63B 53/047* (2013.01); *A63B 53/04* (2013.01); *A63B 2053/002* (2013.01); *A63B 2053/026* (2013.01); *A63B 2053/045* (2013.01); *A63B 2053/0408* (2013.01); *A63B 2053/0454* (2013.01); *A63B 2053/0479* (2013.01)

(58) Field of Classification Search
CPC ..... A63B 2053/045; A63B 2053/0454; A63B 2053/026; A63B 2053/002; A63B 53/04
USPC ..... 473/311, 317, 346, 345, 349, 347, 348, 473/305, 314, 340
See application file for complete search history.

(56) References Cited

U.S. PATENT DOCUMENTS 3,993,314 A 11/1976 Harrington et al.
4,444,392 A 4/1984 Duclos
4,534,564 A 8/1985 Yamada
5,213,328 A 5/1993 Long et al.
5,632,692 A * 5/1997 Lebovici ..... A63B 53/10 273/DIG. 23
5,803,830 A 9/1998 Austin et al.
5,941,782 A * 8/1999 Cook ..... A63B 53/04 473/346
6,257,991 B1 7/2001 Ortiz
6,319,149 B1 11/2001 Lee
7,841,953 B2 11/2010 Stites et al.
8,043,166 B2 10/2011 Cackett et al.
8,182,364 B2 5/2012 Cole et al.
2004/0192461 A1* 9/2004 Chen ..... A63B 53/02 473/311
2010/0178997 A1* 7/2010 Gibbs ..... A63B 53/0466 473/342
2013/0029782 A1* 1/2013 Goto ..... A63B 53/0466 473/345

* cited by examiner

*Primary Examiner* — Benjamin Layno
(74) *Attorney, Agent, or Firm* — IDP Patent Services; Olav M. Underdal

(57) ABSTRACT

A balanced club head includes an encasing with a face plate, a rear side, left and right side, a top side, and a bottom side, defining an interior, right and left inner longitudinal walls, a shaft aperture, a shaft receptacle, a notch in one of the walls, such that the balanced club head is configured to receive a golf shaft, such that the shaft receptacle is configured to receive a lower end of the golf shaft, which protrudes through the shaft aperture with the notch accommodating an angled position of the golf shaft, thereby creating a counter weight and balance that maximizes distance and provides greater accuracy of direction when mounted on a golf club.

21 Claims, 7 Drawing Sheets

Balanced club head

BALANCED GOLF CLUB HEAD

CROSS-REFERENCE TO RELATED APPLICATIONS

N/A.

FIELD OF THE INVENTION

The present invention relates generally to the field of golf club heads, and more particularly to methods and systems for balancing and stabilizing a golf club head.

BACKGROUND OF THE INVENTION

The game of golf remains very popular, and there has been much technological progress on the design of golf clubs and golf club heads, both including new design concepts and use of modern materials.

However, the balance of golf club heads is even in modern golf club designs often not optimal, thereby causing reduced distance and reduced precisions.

As such, considering the foregoing, it may be appreciated that there continues to be a need for novel and improved devices and methods for design of golf club heads.

SUMMARY OF THE INVENTION

The foregoing needs are met, to a great extent, by the present invention, wherein in aspects of this invention, enhancements are provided to the existing model of golf club heads.

In an aspect, a balanced club head can include:

a) a hollow encasing that defines an interior;

b) left and right inner longitudinal wall, which are mounted in the interior, from a front inner side of the encasing to a rear inner side of the encasing.

In a related aspect, the balanced club head can further include:

a) a shaft aperture, which can be configured in a top side of the encasing;

b) a shaft receptacle, which can be positioned in the interior, such that the shaft receptacle is configured to receive a lower end of a golf shaft, which protrudes through the shaft aperture.

In another related aspect, the shaft receptacle can be configured as a female receptor, such that the lower end of the golf shaft can be inserted into the shaft receptacle.

In yet a related aspect, the left inner longitudinal wall further comprises a notch, positioned on an upper side of the left inner longitudinal wall, such that the notch is configured to accommodate an angled position of a golf shaft.

In yet another related aspect, the golf shaft aperture can be configured with a first distance from a left upper side of the golf club to a left side of the golf shaft aperture, and a second distance from to a right side of the golf shaft aperture to a right upper side of the golf club, such that both the first and the second distances are substantially greater than zero.

In related aspect, the counter weight and balance system of the balanced club head provides energy to the club face, and enlarges the sweet spot to more than 80% of the club face, thereby maximizing distance and providing greater accuracy of direction when using a golf club mounted with the balanced club head There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

Figure 1:
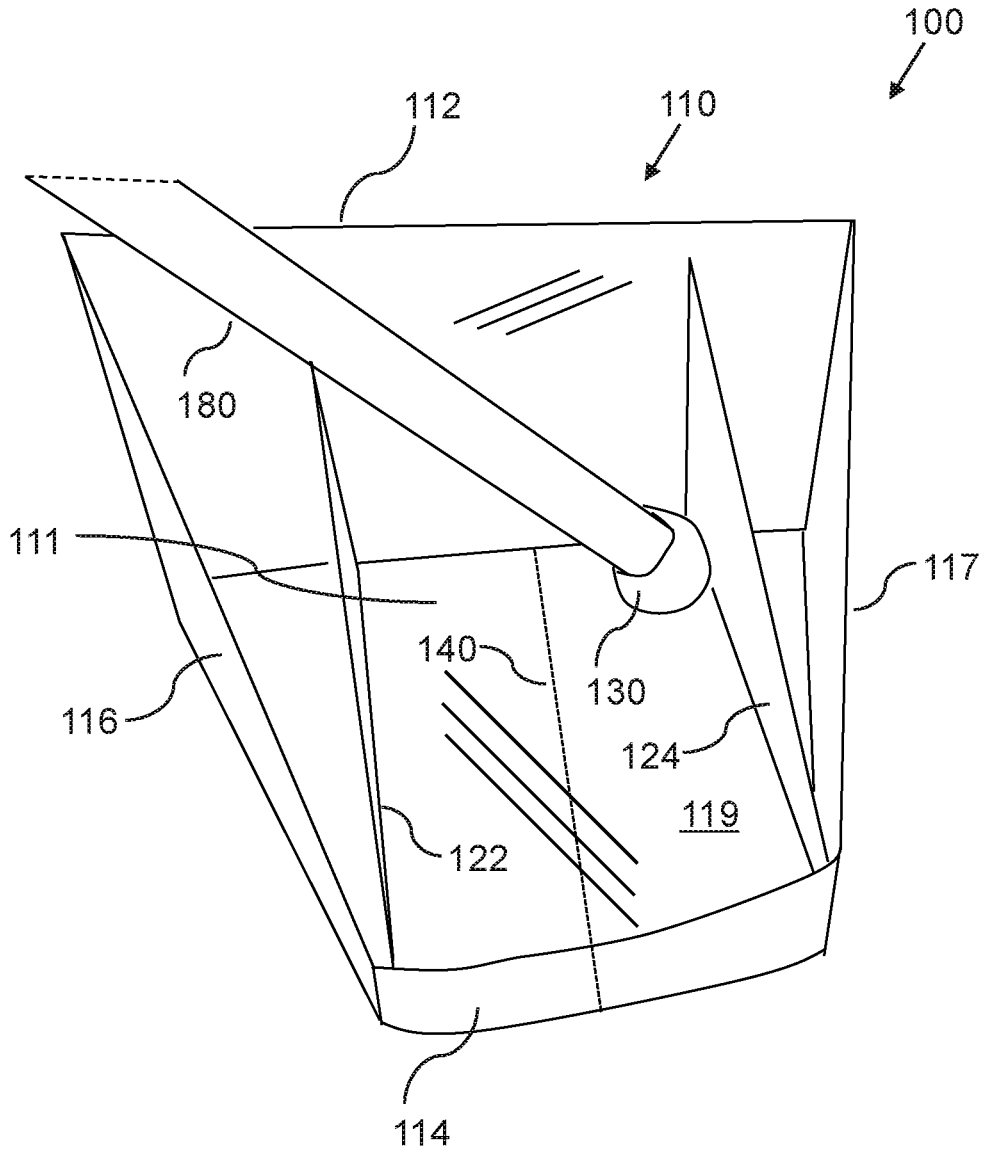
FIG. 1 is a top rear perspective view of part of a balanced golf club head, according to an embodiment of the invention.

In the following, we describe the structure of an embodiment of a balanced club head 100 with reference to FIG. 1, in such manner that like reference numerals refer to like components throughout; a convention that we shall employ for the remainder of this specification.

Figure 3:
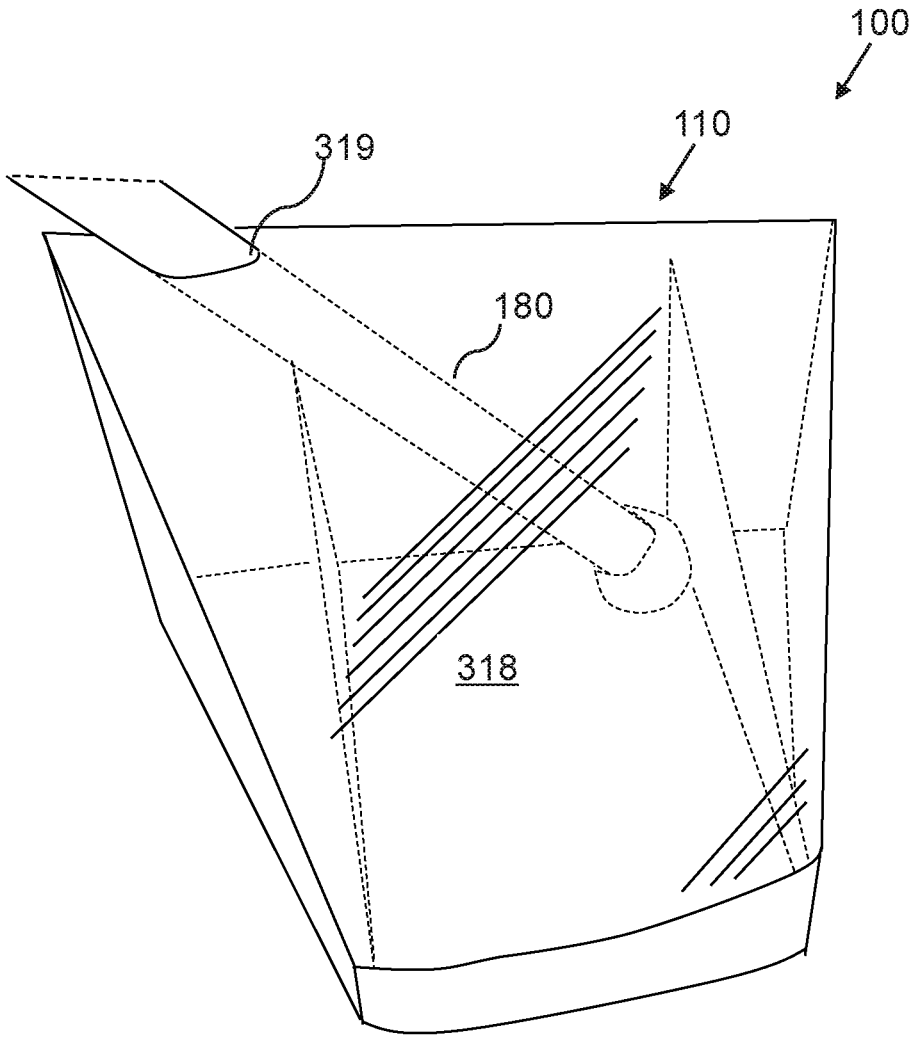
FIG. 3 is a top rear perspective view of a balanced golf club head, according to an embodiment of the invention.

In an embodiment a balanced club head 100 can include:

a) an encasing 110, which is hollow, such that the encasing defines an interior 111, the encasing comprising:

i. a front side 112 or face plate 112;
ii. a rear side 114;
iii. left and right sides 116 117;
iv. a top side 318 (not visible in FIG. 1), as shown in FIG. 3; and
v. a bottom side 119; and b) A left inner longitudinal wall 122, also referred to as a left inner balance bar 122, which is mounted in an interior of the encasing 110, from a front inner side of the encasing 110 to a rear inner side of the encasing 110;

c) A right inner longitudinal wall 124, also referred to as a right inner balance bar 124, which is mounted in an interior of the encasing 110, from a front inner side of the encasing 110 to a rear inner side of the encasing 110, such that the right inner longitudinal wall 124 is mounted to a right side of the left inner longitudinal wall 122; and d) A shaft receptacle 130, which is positioned in an interior of the encasing 110, such that the shaft receptacle 130 is configured to receive a lower end of a golf shaft 180, which protrudes through a shaft aperture 319 in the top side 318 of the encasing 110.

In a related embodiment, the left inner longitudinal wall 122 can further include a notch 223, which can be rounded, shaped as a semi-circle, and positioned on an upper side of the left inner longitudinal wall 122, such that the notch 223 is configured to accommodate an angled position of the golf shaft 180. The notch 223 serves to both allow the position of the golf shaft 180, and may also function to stabilize and secure the golf shaft connection to the balanced golf club head 100. Alternatively, for a left handed golf club, the notch 223 can instead be positioned in an upper side of the right inner longitudinal wall 124.

In a related embodiment, the shaft receptacle 130 can be configured as a female receptor, which is configured to receive the golf shaft 180, such that the lower end of the golf shaft 180 is inserted into the shaft receptacle 130. In alternative related embodiments, the shaft receptacle 130 can be configured as a ferrule connector or a spigot connector, or according to other well-known connector types, such that the shaft slides either inside or over the shaft receptacle 130.

In a related embodiment, the left and right inner longitudinal walls 122 124 can be symmetrically positioned on respectively left and right sides of a longitudinal center line 140.

In related embodiments, according to well-known design principles for golf clubs, a shaft 180 can include a hosel, mounted to a shaft member with a handle, such that a lower end of the shaft 180 is a lower end of the hosel.

Figure 2:
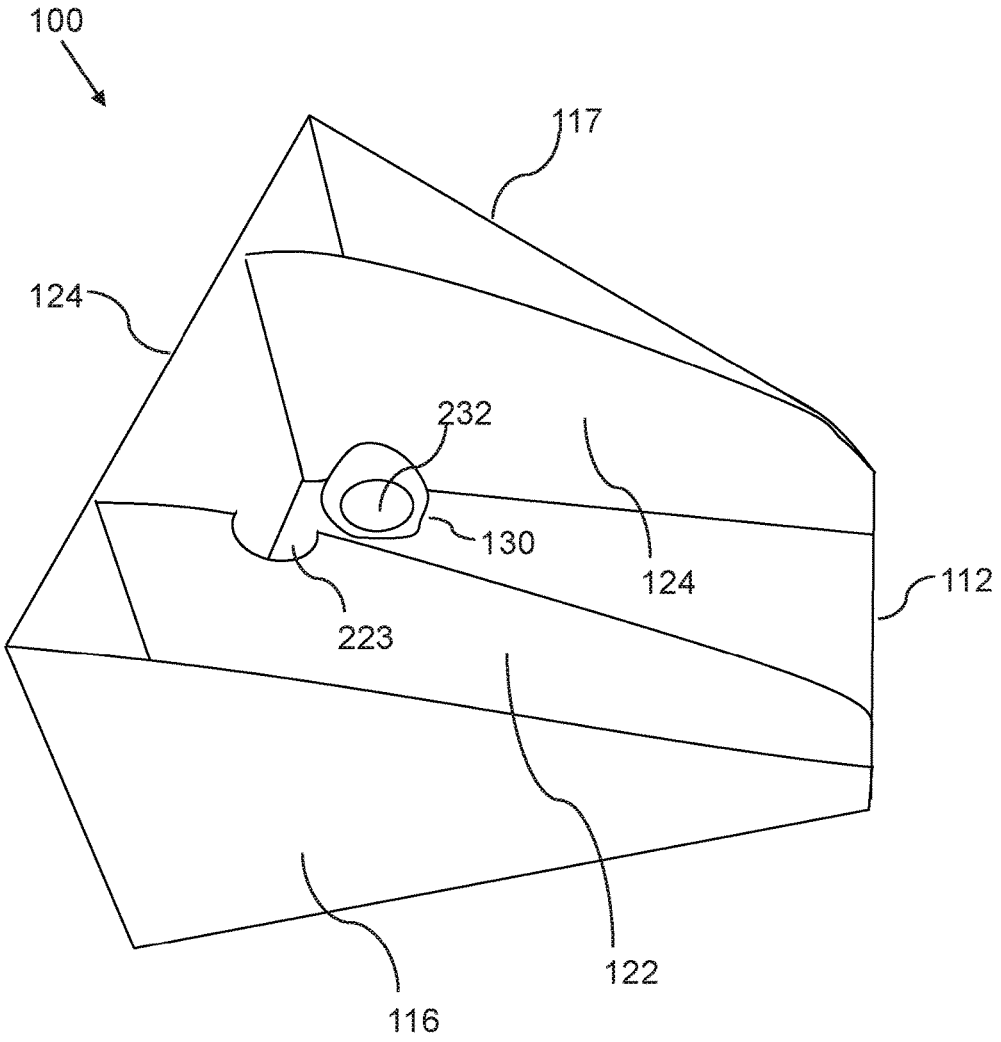
FIG. 2 is a top side perspective view of part of a balanced golf club head, according to an embodiment of the invention.

In another related embodiment, FIG. 2 shows a top side perspective view of part of a balanced golf club head 100, without the top side 318.

In yet a related embodiment, FIG. 3 shows a top rear perspective view of a balanced golf club head 100, including the top side 318, which is configured with a golf shaft aperture/entry point 319.

Figure 4:
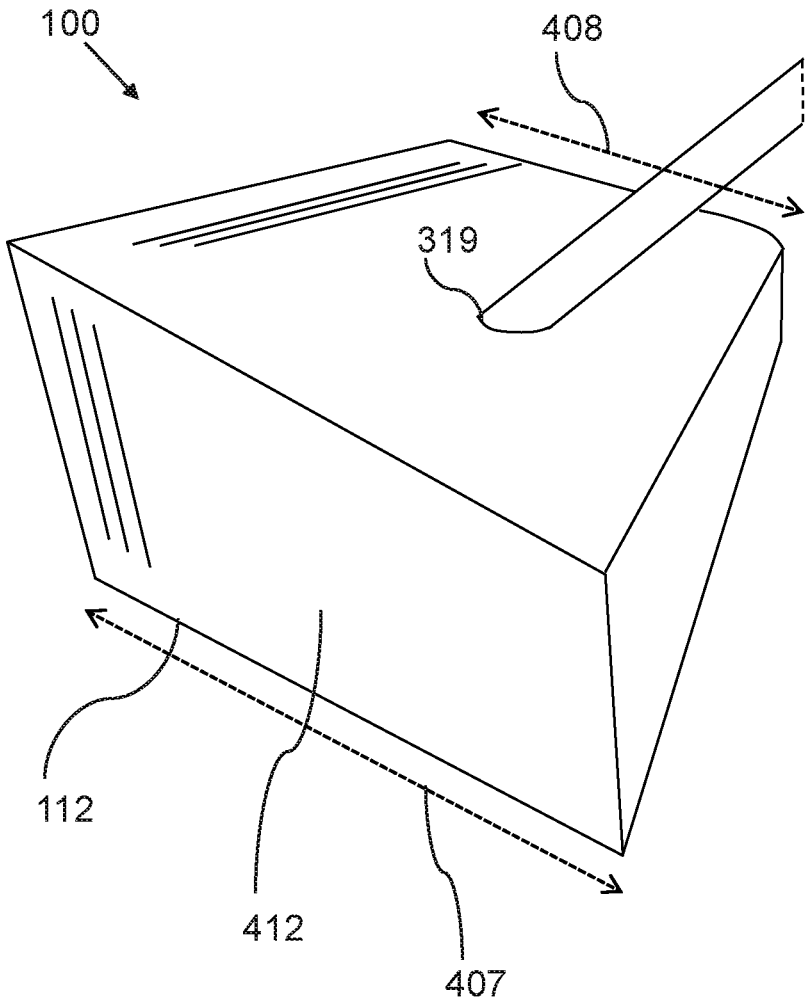
FIG. 4 is a top front perspective view of a balanced golf club head, according to an embodiment of the invention.

In a related embodiment, FIG. 4 shows a top front perspective view of a balanced golf club head 100, showing the face plate 412 of the golf club head which is a front of the front side 112.

Figure 5:
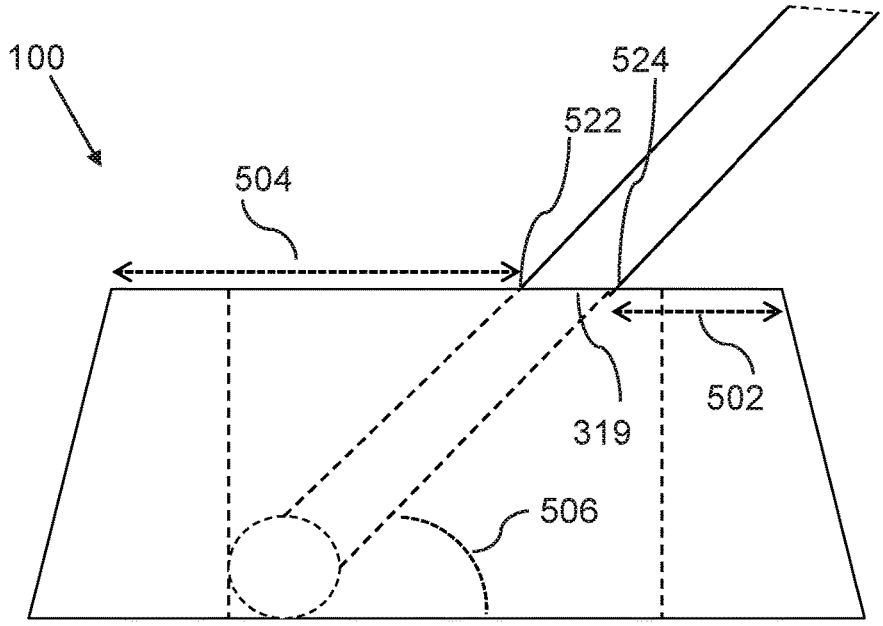
FIG. 5 is a front view of a balanced golf club head, according to an embodiment of the invention.

In a related embodiment, FIG. 5 shows a front view of a balanced golf club head 100, showing the golf shaft 180 mounted to the balanced golf club head 100 with a side inclination angle 506, and with the golf shaft aperture 319 is positioned on an upper side of the balanced golf club head 100 with a first distance 502 from a left upper side of the golf club to a left side 522 of the golf shaft aperture 319, and a second distance 504 from to a right side 524 of the golf shaft aperture 319 to a right upper side of the golf club. This is distinct from conventional golf drivers, woods, and irons, where the shaft is conventionally positioned on a left side of the golf club head, such that the first distance is effectively zero or substantially zero. The entry point 319 can be configured with a first distance substantially greater than zero functions to stabilize and balance a golf club configured with the balanced golf club head 100.

In a further related embodiment, the first distance 502 can be configured in a range of ¼ to 2 inches, ¼ to 3 inches, ½ to 2 inches, or ½-3 inches, or in some other suitable range.

In a further related embodiment, a shaft position ratio between the first and second distances 502 504, can be as shown substantially 1:2.5, or in a range of 1:20 to 2:3, as it relates to a right handed golf club configuration.

Figure 6:
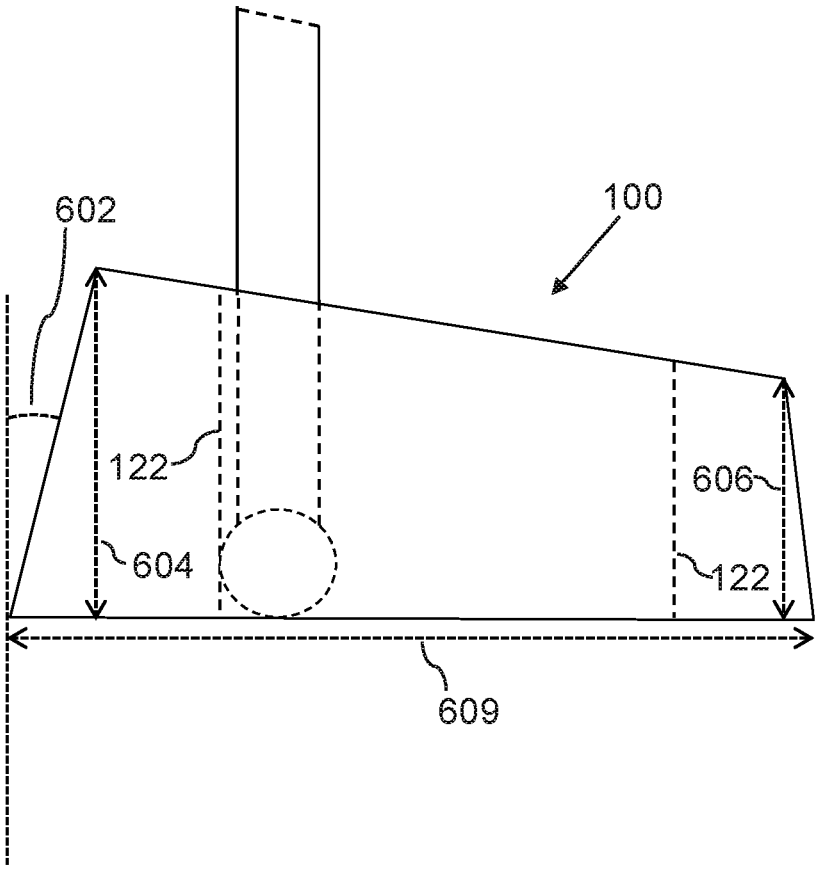
FIG. 6 is a left side view of a balanced golf club head, according to an embodiment of the invention.

In a related embodiment, FIG. 6 shows a left side view of a balanced golf club head 100, further showing:

a. the club face inclination angle 602;
b. the front height 604;
c. the rear height 606;
d. the length 609.

In a related embodiment, FIG. 4 shows a perspective view of a balanced golf club head 100, further showing:

a. the front width 407; and
b. the rear width 408.

In a further related example embodiment, different sizes of a balanced golf club head 100 can be configured with respectively club face inclination angle 602, front and rear heights 604 606, front and rear widths 407 408, and length 609 approximately as specified in Table 1.

TABLE 1

| Club Size | Angle 602 | Front Height 604 | Rear Height 606 | Front Width 407 | Rear Width 408 | Length 609 |
|---|---|---|---|---|---|---|
| #1 (Driver) | 11 | 2" | ½" | 4" | 2" | 4" |
| #2 | 15 | 1½" | ½" | 3½" | 1¾" | 3½" |
| #3 | 19 | 1½" | ½" | 3½" | 1¾" | 3½" |
| #4 | 24 | 1¼" | ½" | 3½" | 1½" | 3½" |
| #5 | 29 | 1¼" | ½" | 3⅛" | 1½" | 2½" |
| #6 | 34 | 1¼" | ½" | 3⅛" | 1½" | 2½" |
| #7 | 39 | 1⅜" | ½" | 3⅛" | 1½" | 2½" |
| #8 | 44 | 1⅜" | ½" | 3¼" | 1⅜" | 1½" |
| #9 | 49 | 1⅜" | ½" | 3¼" | 1⅜" | 1½" |
| Fairway Wedge | 52 | 1½" | ½" | 3¼" | 1⅜" | 1½" |
| Sand Wedge | 55 | 1½" | ½" | 3½" | 1¾" | 1½" |
| Sand Wedge | 59 | 1½" | ½" | 3½" | 1¾" | 1½" |

In a related embodiment, the club face inclination angle 602 can be configured in a range of 10-60 degrees.

In a related embodiment, the front height 604 can be configured in a range of 1-2 inches.

In a related embodiment, the rear height 606 can be configured in a range of ¼-1 inches.

In a related embodiment, the length 609 can be configured in a range of 1-4 inches.

In a related embodiment, the face plate 412 can be made from a light and strong metal or metal alloy, such as for example titanium, titanium alloys, aluminum, and aluminum alloy. The thickness of the face plate 412 can be 1/16", or in a range of 1/32"-1/8". The face plate 412 can further be configured with a beveled edge.

In a related embodiment, the top side 318, rear side 114, left and right sides 116 117, and bottom side 119 can be manufactured from a plastic material, or any type of lightweight and strong material.

In another related embodiment, the balanced club head 100 can be configured with a weight distribution, such that:

a) the encasing 110 weight distribution, is configured such that:
   i. the face plate 112 weighs about 2 oz.;
   ii. the rear side 114 weighs about 1½ oz.;
   iii. the left and right sides 116 117 each weigh about ½ oz.;
   iv. the top side 318 weighs about 1 oz.; and
   v. a bottom side 119 weighs about 2½ oz.; and
b) the right and left inner longitudinal walls 122 124 each weigh about 2 oz.

In yet a related embodiment, the balanced club head 100 can be configured with a weight distribution range, such that:

a) the encasing 110 weight distribution, is configured such that:
   i. the face plate 112 weighs 1-3 oz.;
   ii. the rear side 114 weighs about ¾-3 oz.;
   iii. the left and right sides 116 117 each weigh ¼-1 oz.;
   iv. the top side 318 weighs ½-2 oz.; and
   v. a bottom side 119 weighs 1-4 oz.; and
b) the right and left inner longitudinal walls 122 124 each weigh 1-3 oz.

In a related embodiment, the counter weight and balance system of the balanced club head 100 provides energy to the club face 412, enlarging the sweet spot to more than 80% of the club face 412, thereby maximizing distance and providing greater accuracy of direction when using a golf club mounted with the balanced club head 100.

Figure 7:
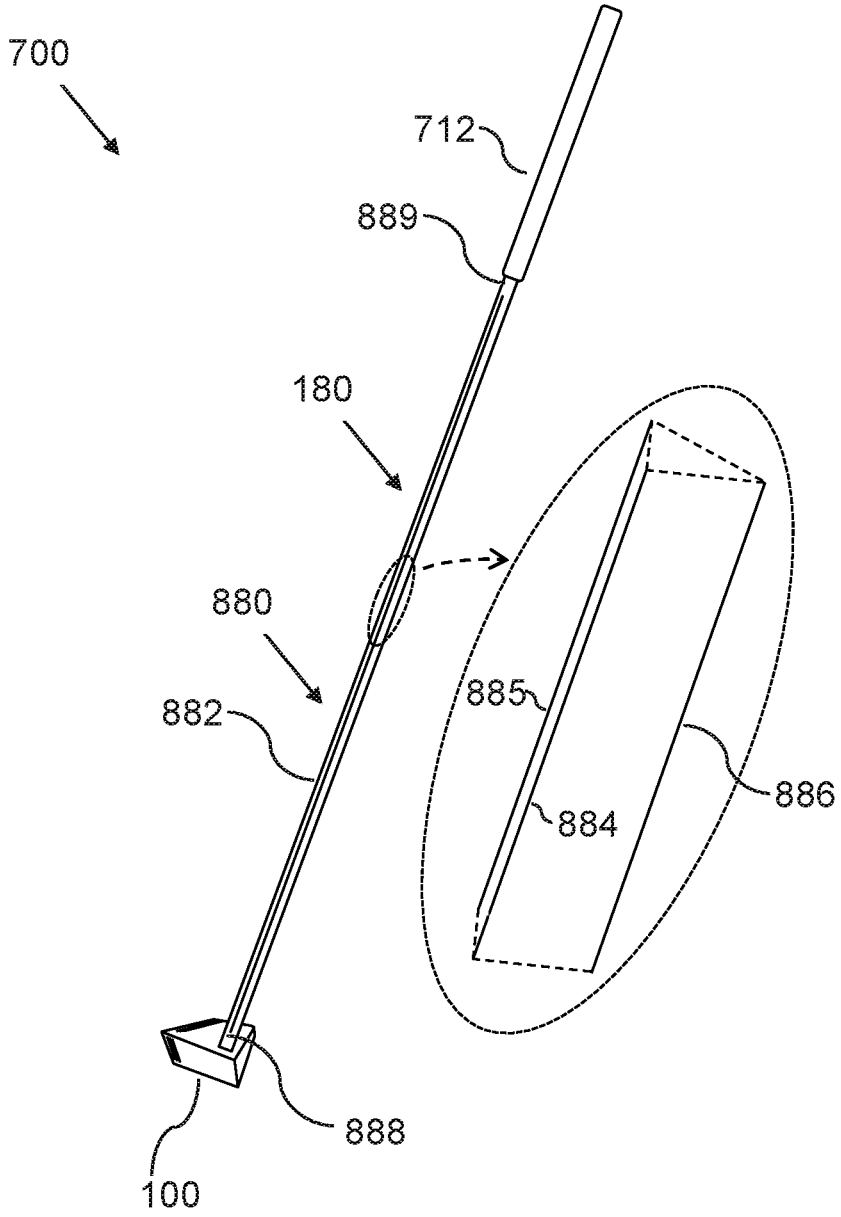
FIG. 7 is a perspective view of a balanced golf club, according to an embodiment of the invention.

In an embodiment, as shown in FIG. 7, a balanced golf club 700 can include:

a) a shaft 180, which can include a handle 712 mounted to an upper end of the shaft 180;
b) a balanced club head 100, which is connected to a lower end of the shaft 180.

In a related embodiment, the shaft 180 can be configured as a triangular golf shaft 880, such that at least a center portion of the shaft 180 has three edges 884 885 886, whereby strength and stiffness of the shaft 880 is enhanced.

In a further related embodiment, as shown in FIG. 7, the edges 884 885 886 can be slightly rounded to ensure that a golf player or bystander cannot accidentally receive skin cut from exposure to the edges 884 885 886.

In a further related embodiment, as shown in FIG. 7, the triangular golf shaft 880 can have a cross-section shaped as an equilateral triangle.

In a further related embodiment, as shown in FIG. 7, the triangular golf shaft 880 can have a front edge 884, which is pointed in a forward direction, which is perpendicular to a plane of the face 412 of the balanced club head 100, whereby wind resistance is minimized during a swing of the balanced golf club 700.

In a further related embodiment, the triangular golf shaft 880 can be configured with a round upper segment 889, which is an upper segment 889 of the triangular golf shaft 880, such that the handle 712 can be mounted to the round upper segment 889, such that a center portion 882 or lower portion of the triangular golf shaft 880 is triangular.

In another further related embodiment, the triangular golf shaft 880 can be configured with a round lower segment 888, which is a lower segment 888 of the triangular golf shaft 880, such that the balanced club head 100 can be mounted to the round lower segment 888, such that a center portion 882 or upper portion of the triangular golf shaft 880 is triangular.

Here has thus been described a multitude of embodiments of the balanced golf club head 100, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent, and should be considered fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. A balanced club head, comprising:

a) an encasing, which is hollow, such that the encasing defines an interior;
b) a left inner longitudinal wall, which is mounted in the interior, from a front inner side of the encasing to a rear inner side of the encasing; and
c) a right inner longitudinal wall, which is mounted in the interior, from the front inner side of the encasing to the rear inner side of the encasing, such that the right inner longitudinal wall is mounted to a right side of the left inner longitudinal wall;
   wherein the left inner longitudinal wall further comprises a notch, positioned on an upper side of the left inner longitudinal wall, such that the notch is configured to accommodate an angled position of a golf shaft.

2. The balanced club head of claim 1, further comprising:

a) a shaft aperture, which is configured in a top side of the encasing; and
b) a shaft receptacle, which is positioned in the interior, such that the shaft receptacle is configured to receive a lower end of a golf shaft, which protrudes through the shaft aperture.

3. The balanced club head of claim 2, wherein the shaft receptacle is configured as a female receptor, such that the lower end of the golf shaft is inserted into the shaft receptacle.

4. The balanced club head of claim 2, wherein the golf shaft aperture is configured with a first distance from a left upper side of the golf club to a left side of the golf shaft aperture, and a second distance from to a right side of the golf shaft aperture to a right upper side of the golf club, such that both the first and the second distances are substantially greater than zero.

5. The balanced club head of claim 4, wherein the first distance is configured in a range of ¼ to 3 inches.

6. The balanced club head of claim 4, wherein a shaft position ratio between the first and second distances is configured in a range of 1:20 to 2:3.

7. The balanced club head of claim 1, wherein the notch is rounded and shaped as a semi-circle.

8. The balanced club head of claim 1, wherein the left and right inner longitudinal walls are symmetrically positioned on respectively left and right sides of a longitudinal center line of the balanced club head.

9. The balanced club head of claim 1, wherein a club face inclination angle of the balanced club head is configured in a range of 10-60 degrees.

10. The balanced club head of claim 1, wherein a front height of the balanced club head is configured in a range of 1-2 inches.

11. The balanced club head of claim 1, wherein a rear height of the balanced club head is configured in a range of ¼-1 inches.

12. The balanced club head of claim 1, wherein a length of the balanced club head is configured in a range of 1-4 inches.

13. The balanced club head of claim 1, wherein the encasing comprises:

a) a face plate;

b) a rear side;

c) left and right sides;

d) a top side; and e) a bottom side;

wherein the face plate is made from a metal, including metal alloys; and the top side, rear side, left and right sides, and bottom side are made from a plastic material.

14. The balanced club head of claim 13, wherein the face plate is configured with a thickness of 1/32"-⅛".

15. A balanced golf club, comprising:

a) a golf shaft; and b) a balanced club head, comprising:

an encasing, which is hollow, such that the encasing defines an interior;

a left inner longitudinal wall, which is mounted in the interior, from a front inner side of the encasing to a rear inner side of the encasing; and a right inner longitudinal wall, which is mounted in the interior, from the front inner side of the encasing to the rear inner side of the encasing, such that the right inner longitudinal wall is mounted to a right side of the left inner longitudinal wall;

wherein the balanced club head is connected to a lower end of the golf shaft;

wherein the left inner longitudinal wall further comprises a notch, positioned on an upper side of the left inner longitudinal wall, such that the notch accommodates an angled position of the golf shaft.

16. The balanced golf club of claim 15, wherein the balanced golf club head further comprises:

a) a shaft aperture, which is configured in a top side of the encasing; and b) a shaft receptacle, which is positioned in the interior, such that the shaft receptacle is connected to the lower end of the golf shaft, which protrudes through the shaft aperture.

17. The balanced golf club of claim 15, wherein the golf shaft is configured as a triangular golf shaft, such that at least a center portion of the golf shaft has three edges.

18. The balanced golf club of claim 17, wherein the triangular golf shaft is configured with a front edge, which is pointed in a forward direction, which is perpendicular to a plane of a face of the balanced club head, whereby wind resistance is minimized during a swing of the balanced golf club.

19. The balanced golf club of claim 17, wherein the triangular golf shaft is configured with a cross-section shaped as an equilateral triangle.

20. The balanced golf club of claim 17, wherein the triangular golf shaft is configured with a round upper segment and a round lower segment, such that the center portion is triangular.

21. The balanced club head of claim 15, wherein the notch is rounded and shaped as a semi-circle.

* * * * *